US008096152B2

(12) United States Patent
Wagh et al.

(10) Patent No.: US 8,096,152 B2
(45) Date of Patent: Jan. 17, 2012

(54) LOCKING SYSTEM FOR A STORAGE CONTAINER

(75) Inventors: Snehal Madhavrao Wagh, Pune (IN); Robert A. Bergum, Woodstock, IL (US); Vinjo Varghese, Pune (IN); Atish Jagdish Bhavsar, Pune (IN)

(73) Assignee: Knaack LLC, Crystal Lake, IL (US)

( * ) Notice: Subject to any disclaimer, the term of this patent is extended or adjusted under 35 U.S.C. 154(b) by 362 days.

(21) Appl. No.: 12/417,719

(22) Filed: Apr. 3, 2009

(65) Prior Publication Data

US 2010/0212376 A1 Aug. 26, 2010

(30) Foreign Application Priority Data

Feb. 20, 2009 (IN) ..... 387/MUM/2009

(51) Int. Cl.
*E05B 67/38* (2006.01)

(52) U.S. Cl. ..... 70/56; 70/80; 70/82; 70/159; 70/164; 292/148

(58) Field of Classification Search ..... 70/54–56, 70/129, DIG. 43, DIG. 56, DIG. 65, 2, 77–84, 70/158–164, 166, 170; 220/210, 315, 324; 292/148, 205, DIG. 18; 312/215–219, 222
See application file for complete search history.

(56) References Cited

U.S. PATENT DOCUMENTS 2,875,604 A * 3/1959 Fohn ..... 70/80
2,912,271 A * 11/1959 Schaefer ..... 292/336.3
3,334,933 A * 8/1967 Ehlers ..... 292/148
4,742,701 A 5/1988 Scavetto
5,076,078 A 12/1991 Weger et al.
5,235,830 A 8/1993 Benge
5,735,146 A 4/1998 Taplin
5,806,351 A * 9/1998 Learnahan ..... 70/56
5,875,948 A 3/1999 Sadler (Continued)

FOREIGN PATENT DOCUMENTS

DE 8334560 4/1984

OTHER PUBLICATIONS

International Search Report for corresponding International App. No. PCT/US2010/022762.

*Primary Examiner* — Lloyd Gall
(74) *Attorney, Agent, or Firm* — McDonnell Boehnen Hulbert & Berghoff LLP

(57) ABSTRACT

A lock system for a tool box is disclosed wherein locking is achieved with a lock which is located in a recessed portion along the front wall of the tool box in order to prevent tampering. A latch rod is slidably disposed adjacent a front wall of the box. The lock and the latch rod are disposed such that the lock body blocks the longitudinal movement of a lock engager and maintains the latch rod in the latched position when the lid of the tool box is in the closed position and the lock is locked. When the lock is unlocked, the lock engager is allowed to move past the lock to move the latch rod to the unlatched position thereby allowing the lid of the tool box to be opened. The lock system may be used for a horizontal or a vertical tool box.

42 Claims, 11 Drawing Sheets

U.S. PATENT DOCUMENTS

| | | | | |
|---|---|---|---|---|
| 6,065,314 | A * | 5/2000 | Nicholson | 70/212 |
| 6,351,975 | B1 | 3/2002 | Valdes | |
| 6,439,008 | B1 | 8/2002 | Keil | |
| 6,494,064 | B1 | 12/2002 | Pena | |
| 6,578,393 | B2 | 6/2003 | Yarborought | |
| 6,668,601 | B1 * | 12/2003 | Reddick | 70/56 |
| 6,681,604 | B1 * | 1/2004 | Samsel | 70/78 |
| 6,772,613 | B2 | 8/2004 | Webb | |
| 6,851,288 | B2 | 2/2005 | Howes | |
| 7,000,440 | B2 | 2/2006 | Martin | |
| 7,318,632 | B2 * | 1/2008 | Bidinger et al. | 312/319.9 |
| 7,418,846 | B2 | 9/2008 | James et al. | |
| 2002/0108410 | A1 | 8/2002 | Webb | |
| 2006/0230795 | A1 | 10/2006 | Kroening | |
| 2007/0240462 | A1 | 10/2007 | James | |
| 2008/0110893 | A1 | 5/2008 | Cowie | |
| 2008/0223091 | A1 * | 9/2008 | Kroening et al. | 70/78 |

* cited by examiner

LOCKING SYSTEM FOR A STORAGE CONTAINER

PRIORITY

This application claims priority to Indian application No. 387/MUM/2009 filed on Feb. 20, 2009, the contents of which is fully incorporated by reference herein.

BACKGROUND

1. Field of the Application

The present invention relates generally to a lock system for a storage container, and more particularly to a lock system in which a padlock or other similar type of lock is located within the container so as to not be exposed to tampering.

2. Description of the Related Art

Containers, such as tool boxes and storage cabinets, which are used at construction job sites and similar locations for storing tools and materials, are typically protected from theft by means of locks. In many instances, due to the value of the tools or materials stored in such containers, it is additionally desirable to use containers having lock systems that shield the lock so that the lock will not be exposed to tampering, such as attempts to cut the lock or pry open the lock body.

Various locking systems have been proposed for both horizontally disposed locking boxes having an upwardly opening lid, as well as vertically disposed locking boxes having vertical doors. In order to prevent would-be thieves from prying open the corners of such boxes, storage cabinets typically include locking mechanisms at both free corners of the cover opposite the hinge. Horizontal tool boxes typically include two padlocks disposed at opposite ends of the box adjacent the locking mechanisms for the free corners of the lid. Using two such padlocks can be inconvenient for the user in that two keys must be maintained and the two padlocks separately actuated to unlock the box. Moreover, if the box is disposed in a truck bed, transverse the vehicle, the user must unlock the lock at one end of the box and then walk around to the opposite side of the truck and unlock the opposite lock. Similarly, when locking the box, the user must ensure that both locks are locked. Thus, locking, checking, and unlocking locks at either end of the box can be a time consuming process with the potential for user error.

As noted above, security is an important issue with respect to jobsite boxes, and thus there is a need to protect the boxes from prying, cutting, and other types of break-ins. U.S. Pat. No. 6,772,613 discloses a lock system for a horizontal locking box that provides protection for a padlock. In this system, the padlock is mounted at one end of the box in a horizontal orientation. A portion of the lock is accessible from the front wall of the box. With this configuration, it is possible to drill out the padlock, as there is enough space and access to position the drill and pass it through the padlock.

Accordingly, there is a need to provide a locking mechanism in which the lock is installed and mounted in such a fashion that it will provide protection against tampering and in particular be drill resistant. Such a locking mechanism must not allow enough space or access to position a drill so as to pass the drill through the lock.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

SUMMARY

In one embodiment, the present application provides a lock system for use in a storage container having a first body component and a second body component. The lock system comprises a latch rod located on the first or the second body component of the storage container, a lock engager coupled to the latch rod, a lock housing positioned on the storage container adapted for having a lock positioned therein, and having at least one slot for accommodating the lock engager, an opening for providing access to a portion of the lock when positioned within the lock housing, the opening being located in an external recessed portion of the storage container, and a handle extending from the latch rod. When the lock is unlocked and the handle is moved in a first direction, the latch rod slides from a latched position to an unlatched position where the lock engager passes through the at least one slot of the lock housing and past the lock. When the handle is moved in a second direction and the lock is locked, the latch rod slides from an unlatched position to a latched position where the lock blocks movement of the lock engager.

In another embodiment, a lock system for use in a horizontal storage container having a first body component and a second body component is provided. The lock system comprises a latch rod located on the first body component of the storage container, a lock engager coupled to the latch rod, a lock housing positioned within the storage container adapted for having a lock oriented vertically therein, and having at least one slot for accommodating the lock engager, an external recessed portion located on the storage container, an opening positioned in the recessed portion for providing access to a portion of the lock when oriented vertically within the lock housing, at least one flange positioned on the second body component, and a handle extending from the latch rod and being accessible from outside the storage container. When the lock is unlocked and the handle is moved laterally in a first direction, the latch rod slides to an unlatched position where the lock engager can move past the lock. When the handle is moved laterally in a second direction and the lock is locked, the latch rod engages the at least one flange and slides to a latched position where the lock blocks movement of the lock engager.

In yet another embodiment, a lock system for use in a vertical storage container having a first body component and a second body component is provided. The lock system comprises a latch rod located on the first body component of the storage container, a lock engager coupled to the latch rod, a lock housing positioned within the storage container adapted for having a lock positioned horizontally therein, and having at least one slot for accommodating the lock engager, an external recessed portion located on the storage container, an opening positioned in the recessed portion for providing access to a portion of the lock when oriented horizontally within the lock housing, at least one flange positioned on the second body component, and a handle extending from the latch rod and being accessible from outside the storage container. When the lock is unlocked and the handle is moved longitudinally in a first direction, the latch rod slides to an unlatched position where the lock engager can move past the lock. When the handle is moved longitudinally in a second direction and the lock is locked, the latch rod engages the at least one flange and slides to a latched position where the lock blocks movement of the lock engager.

BRIEF DESCRIPTION OF THE DRAWINGS

Exemplary embodiments of the invention are described herein with reference to the drawings, in which.

DETAILED DESCRIPTION

The present application provides a locking system for a horizontal or vertical storage cabinet or tool box, which affords protection against tampering and is drill resistant. The lock system can be left in an unlatched position after the lock is unlocked to facilitate repeated opening and closing of the box lid or doors.

Figure 1:
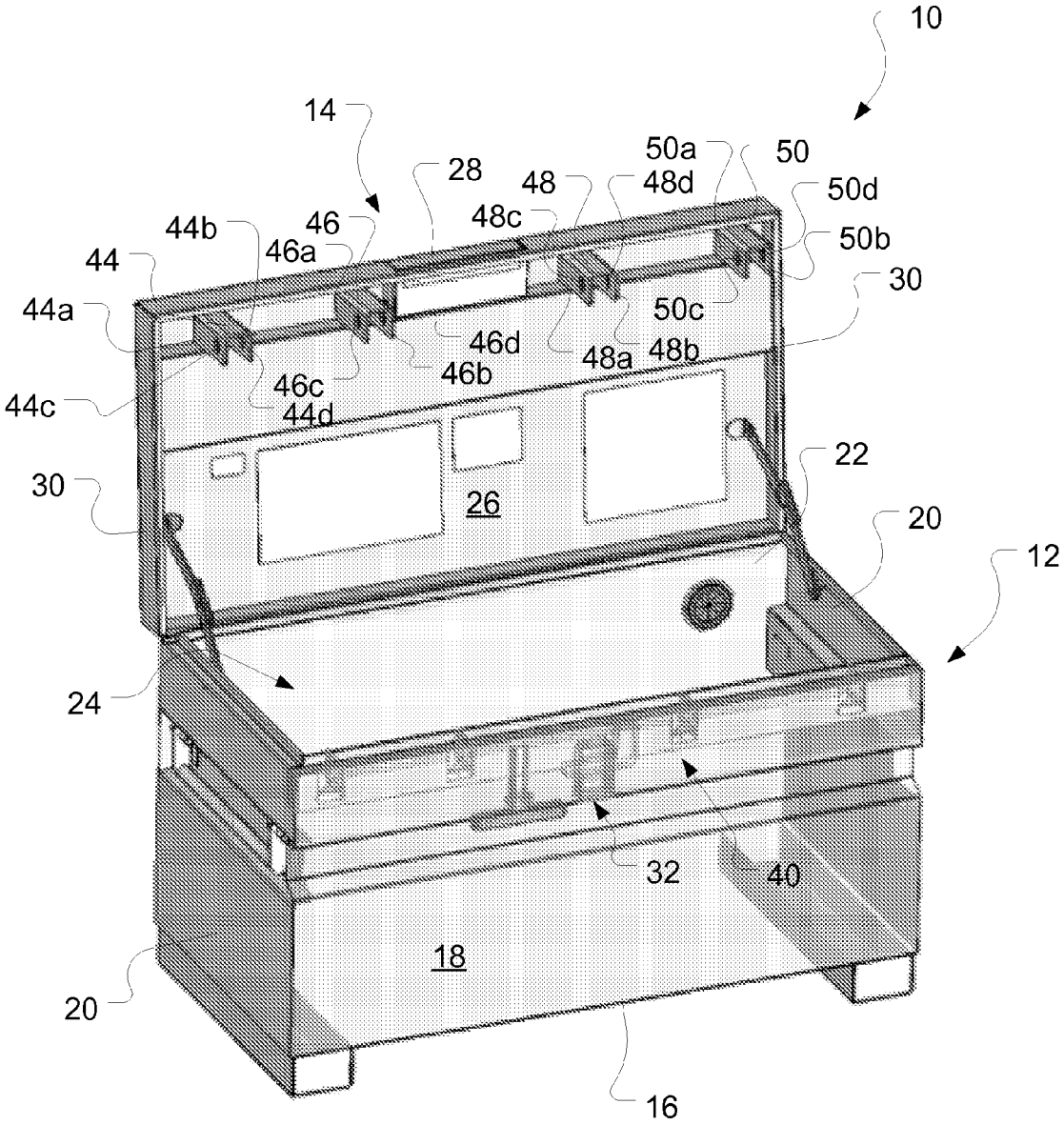
FIG. 1 is a front perspective view of a horizontal tool box incorporating a lock system according to teachings of the present invention.
Figure 2:
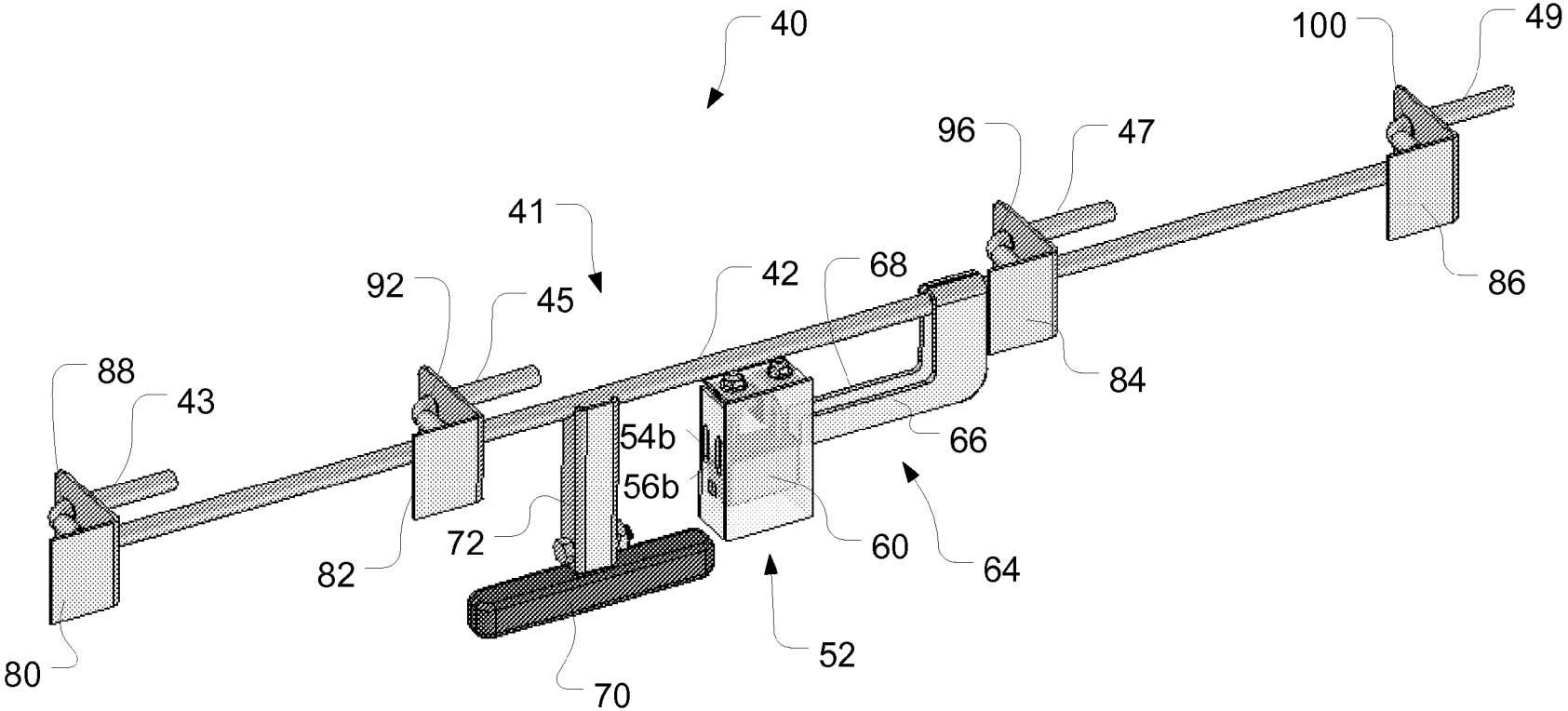
FIG. 2 is a perspective view of the lock system of the present invention.

Turning now to the drawings, FIG. 1 shows a horizontal storage cabinet or tool box 10, which is protected by an embodiment of the lock system of the present invention (identified generally as 40 and shown in detail in FIG. 2). Alternatively, the lock system 40 may be used with a vertical storage cabinet or tool box, as shown in FIGS. 10-14 and described below.

The tool box 10 has a conventional look, with body 12 and lid 14 in the illustrated embodiment. While this description will refer to the body 12 and lid 14 as the first and second components, respectively, it will be appreciated by those skilled in the art that the location of various elements may be disposed along either the first or the second body components, i.e., the lid might alternately be identified as the first body component and the body identified as the second body component.

As illustrated, the body 12 comprises a bottom 16, and front, side, and back walls 18, 20, 22, which define an enclosed space 24. Similarly, the lid 14 includes a top portion 26, and may include front, side, and back walls 28, 30 (back wall not visible in position illustrated in FIG. 1). The body 12 and lid 14 are hingeably coupled along the back wall 22 such that they are movable between the open position illustrated in FIG. 1 and a closed position, further defining the enclosed space. The horizontal tool box may be alternately constructed. For example, the horizontal tool box may be open along the top and a portion of the front wall, and may include a bi-fold lid which covers the top and the open portion of the front wall of the box, as is known by those of skill in the art.

In order to lock the tool box 10 to prevent theft when the box 10 is in its closed position, a lock system 40 is provided, as shown in FIG. 2. The lock system 40 is intended to be used with a lock 60 enclosed in a lock housing 52, and includes a latching mechanism 41 located along the front wall 18 of the box 10. The latching mechanism 41 includes a latch rod 42 and protruding segments 43, 45, 47, and 49 extending from the latch rod 42. The protruding segments 43, 45, 47, and 49 may be positioned offset from the latch rod 42, as shown in FIG. 2. The latch rod 42 is supported in the body 12 for sliding lateral movement between an unlatched position and a latched position wherein protruding segments 43, 45, 47, and 49 of the latch rod 42 are disengaged or engaged, respectively, from flanges 44, 46, 48, and 50 extending from the inside of the lid 14 into the horizontal tool box 10. As may best be seen in FIG. 1, the flanges 44, 46, 48, and 50 are generally disposed equally along the lid 14 of the tool box 10 and extend into the enclosed space 24 defined by the tool box 10. The flanges 44, 46, 48, and 50 may each include a plurality of legs 44*a*, 44*b*, 46*a*, 46*b*, 48*a*, 48*b*, 50*a*, and 50*b*. In order to allow the latch rod 42 to extend through the flanges, each leg of the flanges 44, 46, 48, and 50 includes a bore 44*c*, 44*d*, 46*c*, 46*d*, 48*c*, 48*d*, 50*c*, and 50*d*. It should be understood that the flanges may take an alternate shape, as long as they are able to support the latch rod 42.

Figure 3A:
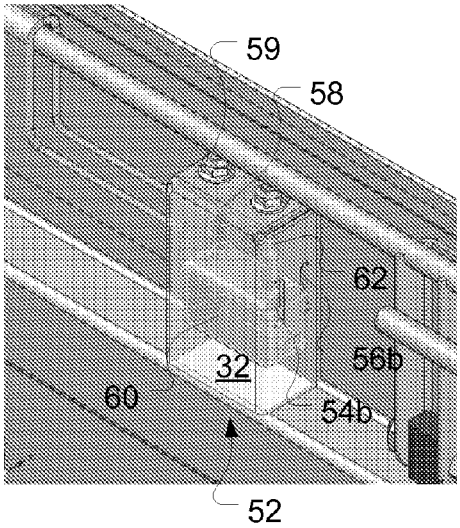
FIG. 3*a* is a perspective view of the lock housing of the present invention.
Figure 3B:
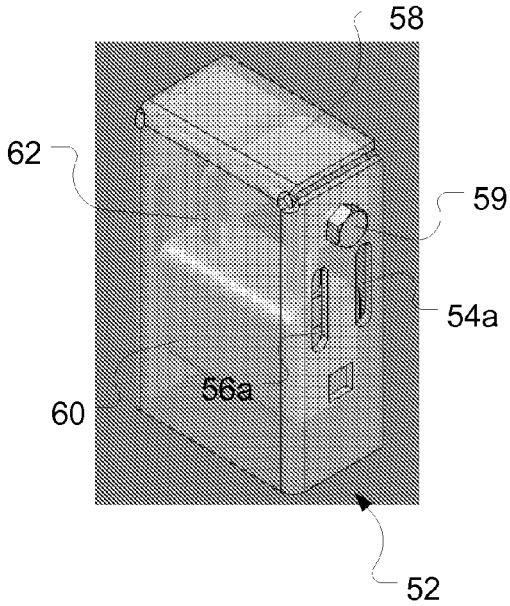
FIG. 3*b* is a perspective view of an alternate embodiment of the lock housing of the present invention.
Figure 3C:
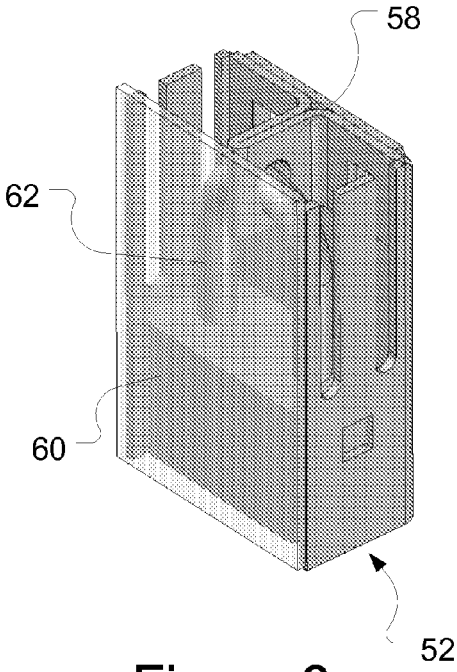
FIG. 3*c* is a perspective view of yet another embodiment of the lock housing of the present invention.
Figure 4:
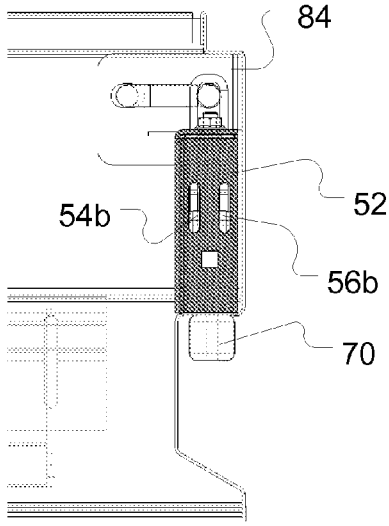
FIG. 4 is a side view of the lock housing shown in FIG. 3*a;*

The lock system 40 also includes a lock, which may be a conventional padlock 60 having a padlock body with a key insertion surface on the bottom (not shown), and a shackle 62, as shown in FIGS. 3*a*-3*c*. It should be understood that other types of locks may be used in the lock system 40, such as combination locks, number swivel locks, and managed access design locks, for example. As is conventional, the shackle 62 and padlock body 60 are movable relative to one another between locked and unlocked positions. In keeping with an important aspect of the invention, the padlock 60 is disposed such that a drill cannot access the padlock in order to maintain the security of the box and prevent tampering with the padlock 60. To provide such an aspect, the access to the padlock 60 may be located in a recessed portion 74 of the front wall of the body 12 (shown in FIGS. 7 and 8) to avoid tampering with the padlock, as mentioned below.

In order to secure the padlock 60 within the tool box 10, a lock housing 52 is provided. FIG. 3*a* shows the padlock 60 being disposed in a vertical orientation within the lock housing 52. In this orientation, the key insertion surface is accessible from the bottom of the lock housing 52 via an opening 32 in the tool box 10, discussed below. Although the lock housing 52 is shown as a box having four side walls, it will be appreciated that the lock housing 52 may have less than four side walls. Further, the lock housing may be configured differently in order to accommodate different types of locks. The lock housing 52 may include a lock bracket 58 mounted to a top wall of the lock housing 52 for receiving the shackle 62 of the padlock 60. Alternatively, the lock bracket 58 may be mounted to a side wall of the lock housing 52, as illustrated in FIG. 3*c*. The lock bracket 58 includes one or more openings through which the shackle 62 may extend. The lock bracket 58 is preferably coupled to the lock housing 52 by at least one fastener 59, in this case a nut and bolt. As shown in FIGS. 3*a* and 3*b*, the fastener 59 may be secured to either the top wall or the side wall of the lock housing. The lock housing 52 may be further secured to the front wall 18 of the tool box 10 by any appropriate method, such as welding or the like.

In order to permit the user to activate the padlock 60 while protecting the shackle 62 and its connection to the padlock body from tampering, the lock housing 52 disposes the padlock 60 adjacent an opening 32 (best seen in FIG. 3*a*) in the front wall 18 of the tool box 10, such that the key insertion surface is accessible from the outside of the box 10. Inasmuch as the padlock body 60 is slidable within the lock housing 52 relative to the secured shackle 62, the user may push upward on the padlock body within the lock housing 52 to lock the padlock 60, or actuate the key and pull down on the padlock body to unlock the padlock 60 to the open position, as illustrated in FIGS. 5 and 6.

The lock system 40 further comprises a lock engager 64 coupled to the latch rod 42. The lock engager 64 may include a pair of legs 66, 68. Alternatively, the lock engager may include only one leg. Those skilled in the art will appreciate that the leg could take an alternate form, such as a rod, slat, etc. The legs 66, 68 of the lock engager align with slots 54*a*, 56*a* and 54*b*, 56*b* of the lock housing 52, as best seen in FIGS. 3*a* and 3*b*, when the padlock 60 is in the unlocked position. It should be understood that the slots may take an alternate shape such as a circular or a rectangular opening or may be formed as apertures, holes, slits, etc. When the padlock 60 is in the unlocked position, the legs 66, 68 of the lock engager 64 are able to move past the shackle 62 of the padlock 60. When the padlock 60 is in the locked position, however, the legs 66, 68 of the lock engager 64 are blocked by the padlock body from moving past the padlock 60 and through slots 54*b* and 56*b* of the lock housing 52.

Figure 5:
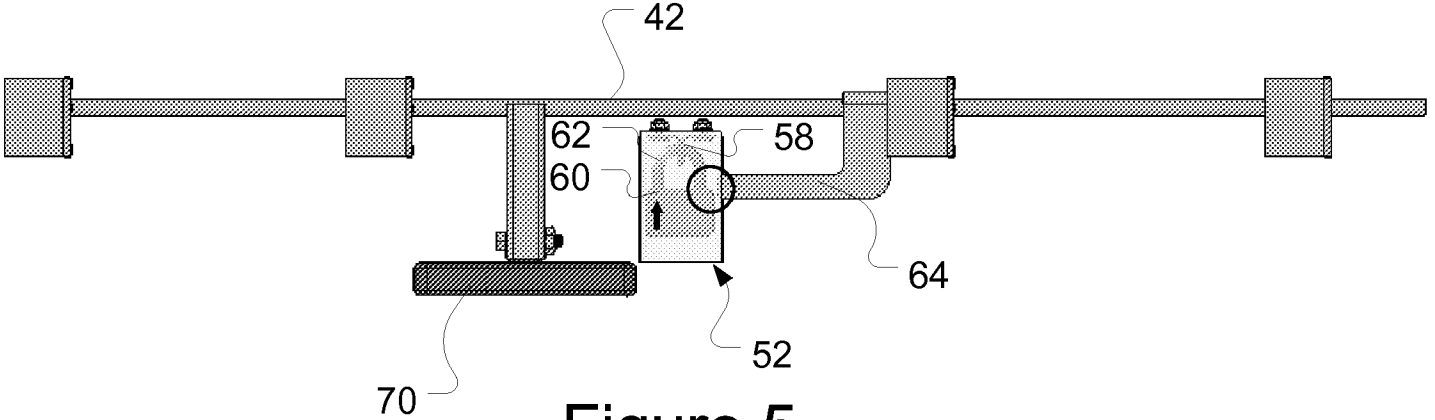
FIG. 5 is a front view of the lock system shown in FIG. 2 in the locked position.
Figure 6:
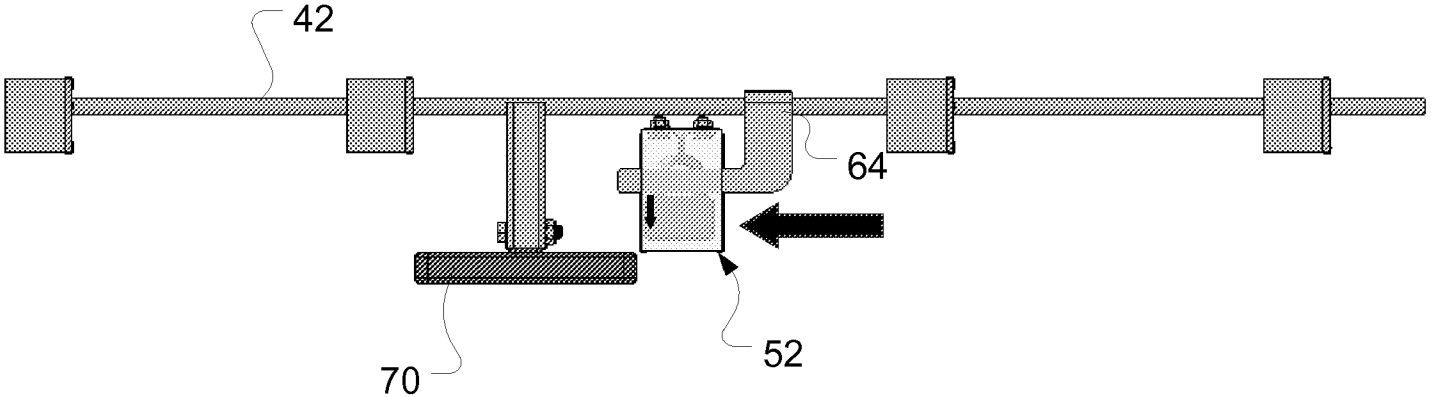
FIG. 6 is a front view of the lock system shown in FIG. 2 in the unlocked position.

The latch rod 42 is disposed relative to the lock housing 52 such that when the horizontal tool box 10 is in the closed position and the latch rod 42 is in the latched position illustrated in FIG. 5, the padlock body of the locked padlock 60 blocks the lateral movement of the lock engager 64 to prevent the lock engager 64 and the latch rod 42 from moving into the unlatched position. Conversely, when the padlock 60 is in the unlocked position, as is illustrated in FIG. 6, the padlock body no longer blocks the lateral movement of the lock engager 64 or latch rod 42. More specifically, when the padlock 60 is in the unlocked position shown in FIG. 6, the lock engager 64 is free to advance through the slots 54*a*, 56*a* and 54*b*, 56*b* of the lock housing 52 and past the padlock shackle 62. In this way, when the padlock 60 is unlocked, the latch rod 42 is free to be moved into the unlatched position, thereby allowing the lid to be moved to an open position. Conversely, when the padlock 60 is in the locked position, as shown in FIG. 5, the lock engager 64 enters slots 54*a* and 56*a* of the lock housing 52, but then abuts the body of the padlock 60 to prevent lateral movement of the latch rod 42. In this position, the lid 14 of the tool box 10 cannot be moved to an open position.

Figure 7:
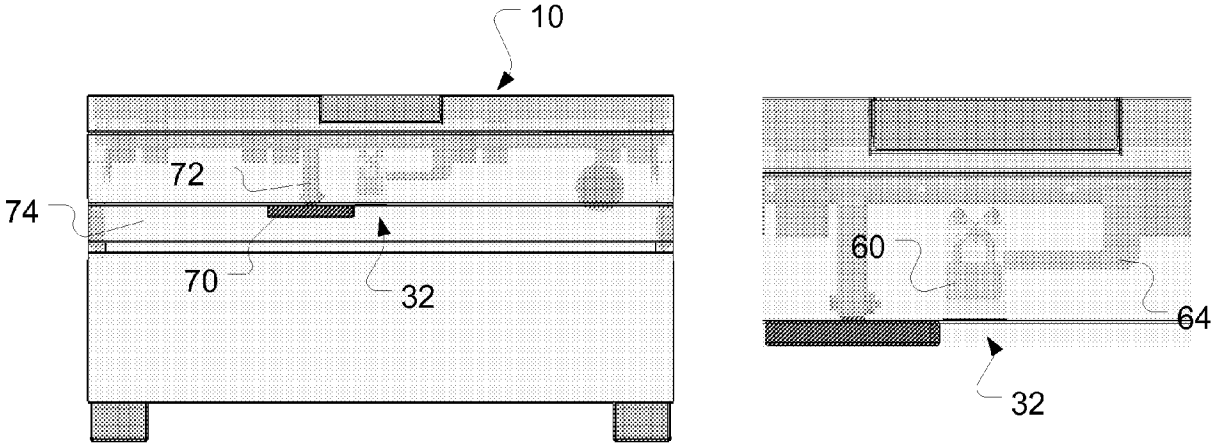
FIG. 7 is a front view of the box shown in FIG. 1 in the locked position.
Figure 8:
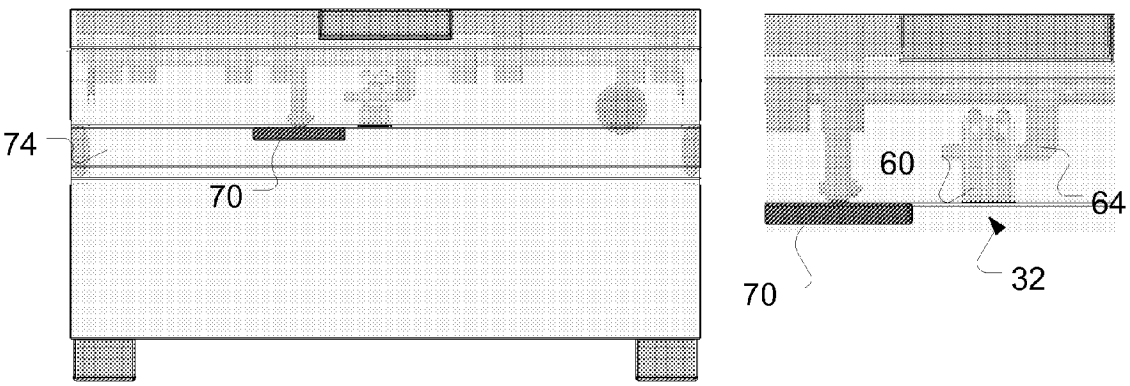
FIG. 8 is a front view of the box shown in FIG. 1 in the unlocked position.
Figure 8A:
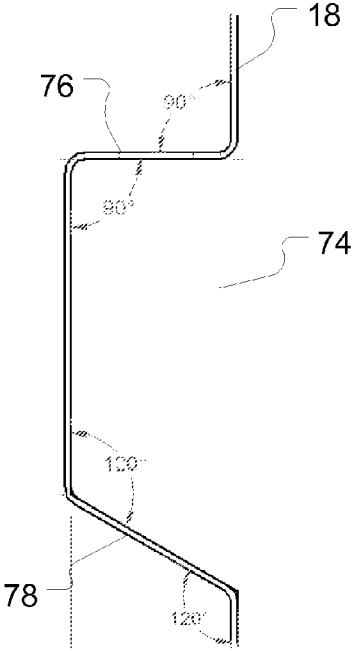
FIG. 8*a* is a side view of the recessed portion of the box shown in FIG. 1.

To facilitate lateral movement of the latch rod 42 within the tool box 10, the latch rod 42 includes a handle 70 which may be secured to the latch rod 42 by bracket 72, and is accessible to the user from the outside of the horizontal tool box 10, as shown in FIGS. 7 and 8. It should be understood that the handle 70 may be of any appropriate form, such as a rod or knob, or any other structure suitable for a user to grasp to move the latch rod 42 to open and close the tool box 10. To minimize opportunity for damage to the handle 70, the handle 70 preferably extends generally downward from the latch rod 42 and through an elongated slot in the upper wall of an external recessed portion 74 of the front wall 18 of the box 10. The recessed portion 74 is shown in detail in FIG. 8*a*.

The particular size and configuration of the recessed portion 74 depends upon the type of lock used. In one embodiment, the recessed portion has a top portion 76 which is positioned at an angle of approximately 90° with the front wall 18 of the box 10, and a bottom wall 78 which is positioned at an angle of approximately 120° with the front wall 18. Not only does the recessed portion 74 present an aesthetically pleasing, stylish appearance for the box, it also contributes a tamper-proof aspect as it makes it difficult for a drill to access the padlock body. As is apparent from the figures, the only access to the lock 60 from the outside is through opening 32 which is located in the recessed portion 74. Recessed portion 74 is sized so that a drill cannot be positioned therein to tamper with the padlock body through the opening 32. Although the recessed portion 74 is shown as extending along the entire length of the front wall 18, it should be understood that the recessed portion 74 may extend along only a portion of the length of the front wall 18. Furthermore, the recessed portion 74 may be constructed as separate, multiple recessed portions along the front wall 18.

In use, the user may move the handle 70 laterally within the recessed portion 74 to slide the latch rod 42 between the latched and unlatched positions. When the handle 70 is moved in a first direction, the latch rod 42 slides into an unlatched position, and when the handle 70 moves in a second direction, which may be opposite the first direction, the latch rod 42 slides into a latched position. While the handle 70 is illustrated as disposed near the center of the box 10, it could alternatively be disposed anywhere along the front section 18 of the box 10 to facilitate access by a user.

Figure 9:
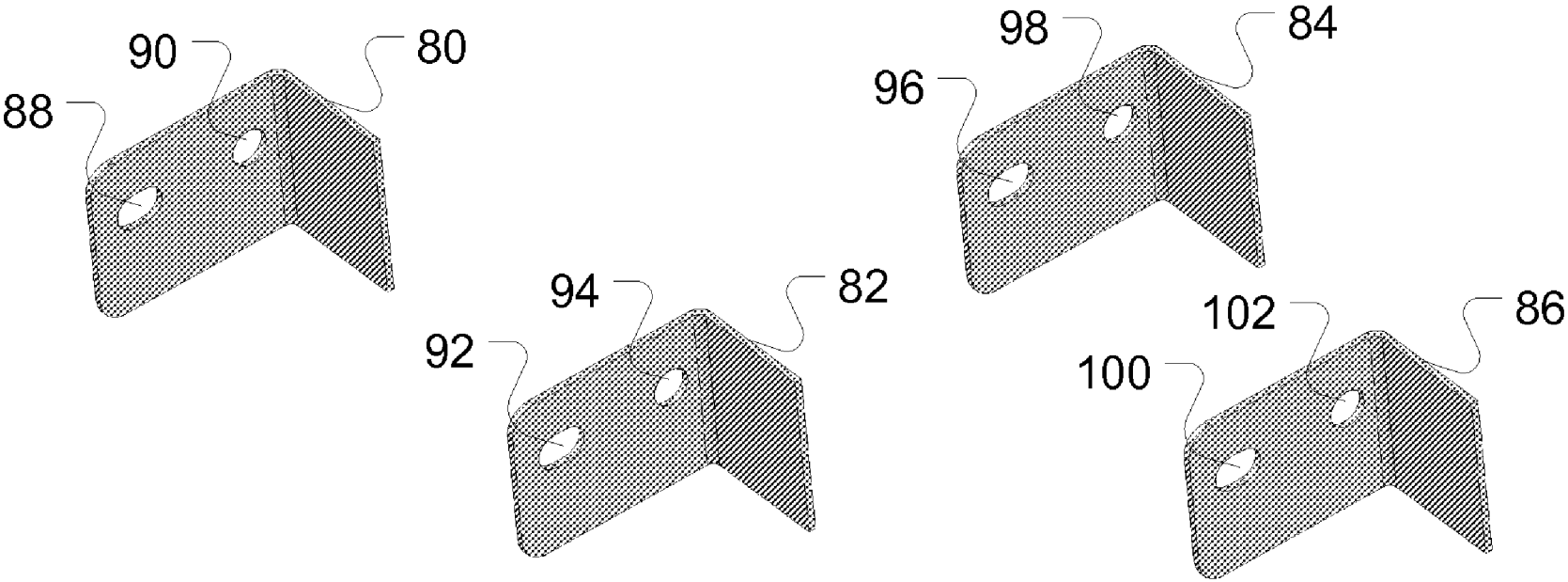
FIG. 9 is a perspective view of the brackets used with the lock system of the present invention.
Figure 11:
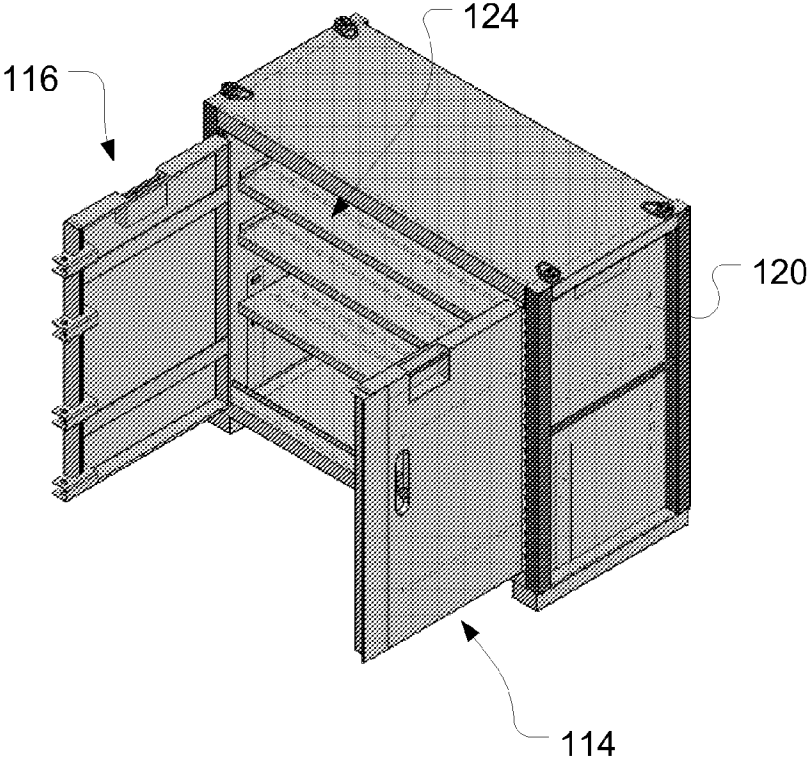
FIG. 11 is a perspective view of the vertical box in the unlocked position.

Referring again to FIG. 2, the latch rod 42 includes a plurality of brackets 80, 82, 84 and 86 which support the protruding segments 43, 45, 47, and 49 of the latch rod 42. The brackets 80, 82, 84 and 86 may secure the lock system 40 to the box 10 and serve as a guide for latch rod 42 and the protruding segments 43, 45, 47, and 49. While the brackets 80, 82, 84 and 86 may be of any appropriate form, they each have a generally L-shape and include a first bore 88, 92, 96, and 100 for supporting the protruding segments 43, 45, 47, and 49, and a second bore 90, 94, 98, and 102 for supporting the latch rod 42, as shown in FIG. 9. Although four brackets are shown, more or less brackets may be used to secure the lock system 40 to the box 10.

It will be appreciated by those of skill in the art that lock system 40 protrudes only minimally into the enclosed space 24 defined by the body 12 and lid 14. This is due to the particularized structure of the latch rod 42 in that it is disposed substantially adjacent the front wall 18 of the body 12. The protruding segments 43, 45, 47, and 49 are then offset only as much as necessary to obtain the desired latching capabilities. Those of skill in the art will further appreciate that the latch rod 42 moves along a first lateral axis within the body 12, while the offset protruding segments are slidably disposed along parallel lateral axes. The flanges 44, 46, 48, and 50 extending from the lid 14 are thus disposed in planes perpendicular to the axis of the latch rod 42.

The lock system may also be provided a vertical tool box 110, and is identified generally as 140 in FIGS. 10-14. Vertical box 110 includes a body 112, and two doors 114 and 115. The body 112 comprises a bottom wall 116, a top wall 118, side walls 120, and a back wall (not visible in the position illustrated in FIGS. 10 and 11) which define an enclosed space 124. The doors 114, 115 are hingeably coupled to side walls 120 such that they are movable between the closed position illustrated in FIG. 10 and the open position illustrated in FIG. 11. While this description will refer to the body 112 and doors 114, 115 as the first and second components, respectively, it will be appreciated by those skilled in the art that the location of various elements may be disposed along either the first or the second body components, i.e., the doors might alternately be identified as the first body component and the body identified as the second body component.

Figure 12:
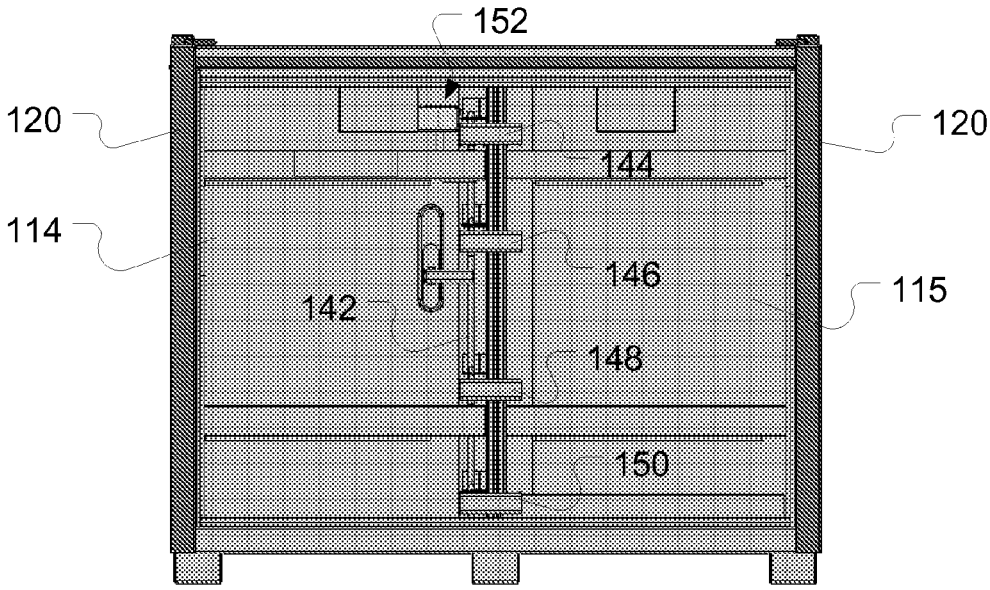
FIG. 12 is a back view of the doors of the vertical box in the locked position.

The lock system 140 may be located on one door 114 while a plurality of flanges 144, 146, 148, and 150 may be located on the other door 115, as shown in FIG. 12. The lock system 140 is constructed substantially similar to the lock system 40 described above, and includes a latch rod 142, a lock 160 enclosed in a lock housing 152, and a lock engager 164, which are shown in detail in FIG. 13. The flanges 144, 146, 148, and 150 are generally disposed equally along the door 115 of the box 110 and extend perpendicular from the door 115. The flanges may be constructed similar to flanges 44, 46, 48, and 50 described above.

Figure 13:
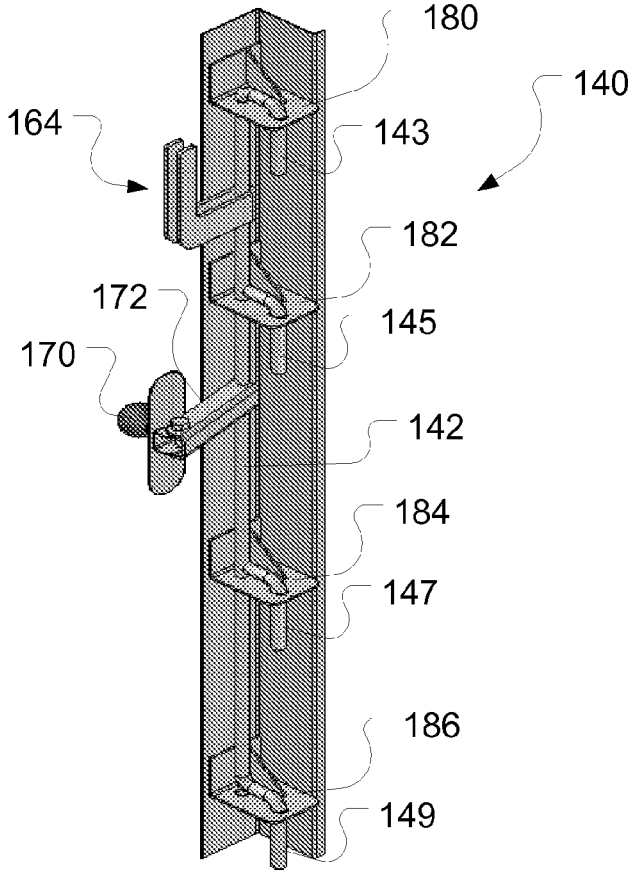
FIG. 13 is a perspective view of the lock system shown in FIG. 12.

Turning to FIG. 13, the lock system 140 includes latch rod 142 having protruding segments 143, 145, 147, and 149 extending therefrom. The protruding segments 143, 145, 147, and 149 may be positioned offset from the latch rod 142. The latch rod 142 is supported on door 114 for sliding longitudinal movement between an unlatched position and a latched position wherein protruding segments 143, 145, 147, and 149 of the latch rod 142 are disengaged from or engaged to, respectively, flanges 144, 146, 148, and 150 extending from the other door 115.

Figure 14:
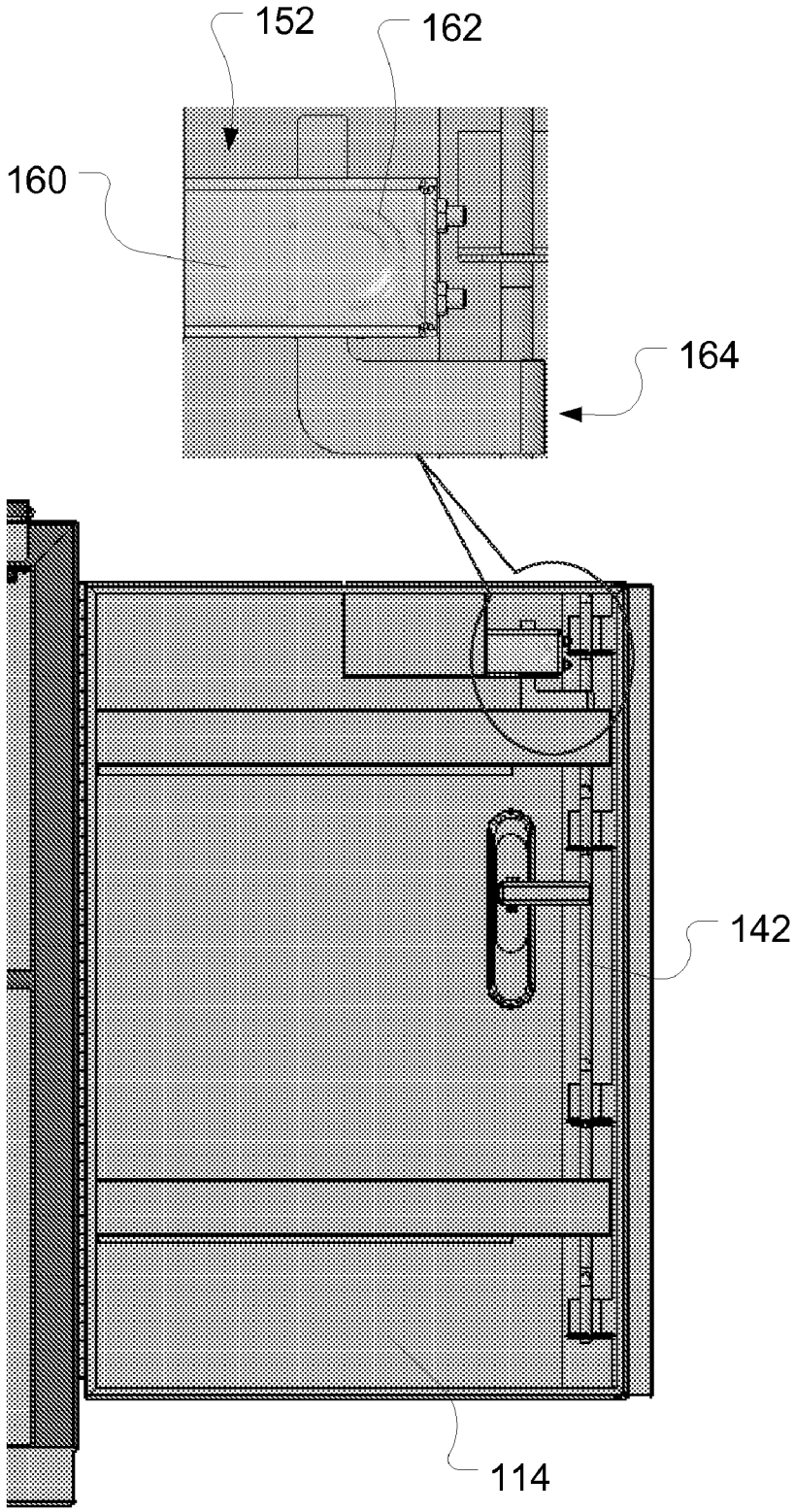
FIG. 14 is a back view of the lock system of FIG. 12 in the unlocked position.

The lock system 140 further includes a lock, which may be a conventional padlock 160 having a padlock body with a key insertion surface at one end (not shown), and a shackle 162, as shown in FIG. 14. As mentioned above, other types of locks may also be used with lock system 140. The padlock 160 is constructed substantially similar to padlock 60 described above and is disposed in a horizontal orientation in a lock housing 152. In keeping with an important aspect of the invention, the padlock 160 and lock housing 152 are disposed such that a drill cannot access the padlock in order to maintain the security of the box 110 and prevent tampering with the padlock 160. The access to the padlock 160 may be located in a recessed portion 174 (shown in FIG. 10) of the door 114 further avoid tampering with the padlock, as mentioned below. As is apparent from the figures, the only access to the lock 160 from the outside is through opening 132 which is located in the recessed portion 174. As with recessed portion 74, recessed portion 174 is sized so that a drill cannot be positioned therein to tamper with the padlock body through the opening 132.

As shown in FIGS. 13 and 14, the lock system 140 further comprises a lock engager 164 coupled to the latch rod 142. The lock engager 164 may be constructed substantially similar to lock engager 64 and may function in a similar manner as the lock engager 64, described above. Thus, when the padlock 160 is in the unlocked position, the legs of the lock engager 164 are able to move past the shackle of the padlock 160. When the padlock 160 is in the locked position, however, the legs of the lock engager 164 are blocked from moving past the padlock 160 by the padlock body.

The latch rod 142 is disposed relative to the lock housing 152 such that when the vertical tool box 110 is in the closed position and the latch rod 142 is in the latched position, the padlock body of the locked padlock 160 blocks the vertical or longitudinal movement of the lock engager 164 to prevent the lock engager 164 and the latch rod 142 from moving into the unlatched position. Conversely, when the padlock 160 is in the unlatched position, as is illustrated in FIG. 14, the padlock body no longer blocks the vertical or longitudinal movement of the lock engager 164 or latch rod 142. In this position, the doors 114, 115 of the tool box 110 can be moved to an open position.

Figure 10:
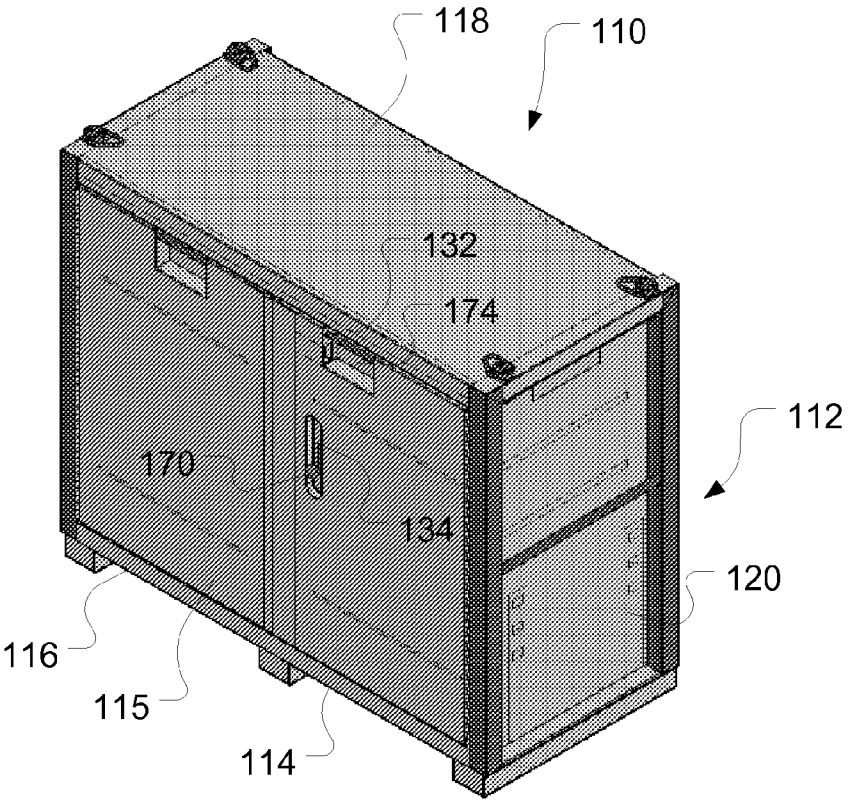
FIG. 10 is a front perspective view of a vertical tool box incorporating a lock system according to teachings of the present invention.

To facilitate longitudinal movement of the latch rod 142 within the tool box 110, the latch rod 142 includes a handle 170 which is secured to the latch rod 142 by bracket 172, and is accessible to the user from the outside of the vertical tool box 110, as shown in FIG. 10. To minimize opportunity for damage to the handle 170, the handle 170 preferably extends generally outward from the latch rod 142 and through an elongated slot 134 in the door 114 of the box 110. As mentioned above, the handle 170 may be of any appropriate form, such as a rod or knob, or any other structure suitable for a user to grasp to move the latch rod 142 to open and close the box 110.

In use, the user may move the handle 170 longitudinally within the slot 134 to slide the latch rod 142 between the latched and unlatched positions. When the handle 170 is moved in a first direction, the latch rod 142 slides into an unlatched position, and when the handle 170 moves in a second direction, which may be opposite the first direction, the latch rod 142 slides into a latched position. While the handle 170 is illustrated as disposed near the center of the box 110, it could alternatively be disposed anywhere along the door 114 of the box 110 to facilitate access by a user.

Referring again to FIG. 13, the latch rod 142 includes a plurality of brackets 180, 182, 184 and 186 which support the protruding segments 143, 145, 147, and 149 of the latch rod 142. The brackets 180, 182, 184 and 186 may be constructed and may function substantially similar to the brackets 80, 82, 84, and 86 described above.

Figure 16B:
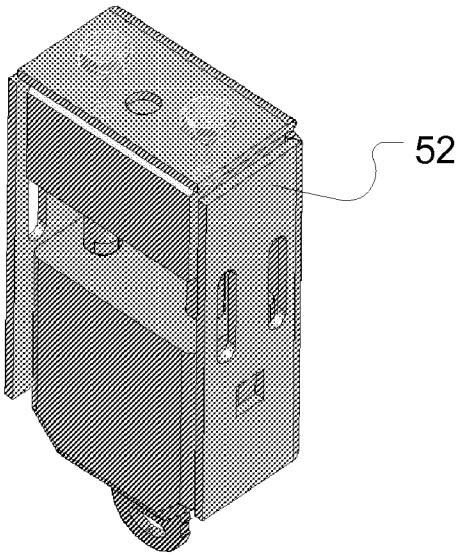
FIG. 16*b* is a perspective view of the alternate lock of FIG. 15 in the unlocked position.
Figure 16A:
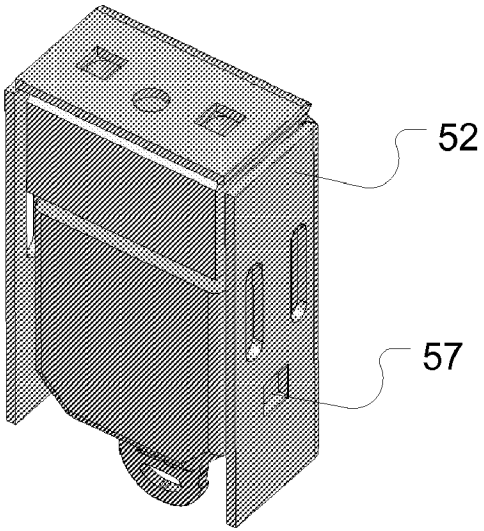
FIG. 16*a* is a perspective view of the alternate lock of FIG. 15 in the locked position.
Figure 15:
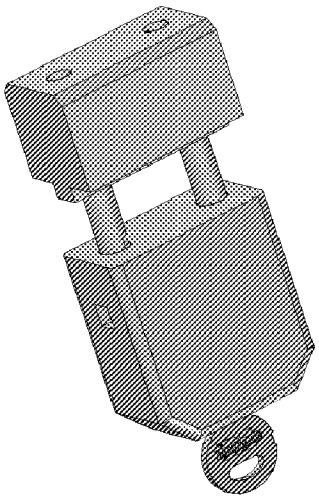
FIG. 15 is a perspective view of an alternate lock which may be used with the lock system of the present invention.

According to another feature of the invention, the lock housing 52 or 152 may be structured such that it can utilize more than one size or type of lock. Referring now to FIGS. 15, 16*a*, and 16*b*, there is illustrated an alternative type of lock that may be used with the lock system of the present invention. FIG. 15 shows a managed access design lock. As shown in FIGS. 16*a* and 16*b*, the managed access design lock is secured directly to a top wall of the lock housing 52 without the need for a lock bracket. FIG. 16*a* shows the managed access design lock in the locked position within the lock housing 52, and FIG. 16*b* shows the managed access design lock in the unlocked position within the lock housing 52. Those of skill in the art will appreciate that this arrangement provides great versatility in the user's choice and use of a desired padlock.

The lock housing 52 may also include an aperture 57 on either or both sides located below the slots 54*a*, 56*a* and 54*b*, 56*b* of the lock housing 52. Although aperture 57 is shown as a square, it may take an alternate shape, such as a circle or rectangle. Aperture 57 allows a tool (not shown) to be introduced into an access port on the managed access design lock so that the cylinder of the lock may be easily removed. Thus, a variety of different lock cylinders, such as a conventional cylinder with a conventional key, or a Videx lock cylinder with an electronic key, may be used in the present lock system 40.

Figure 17:
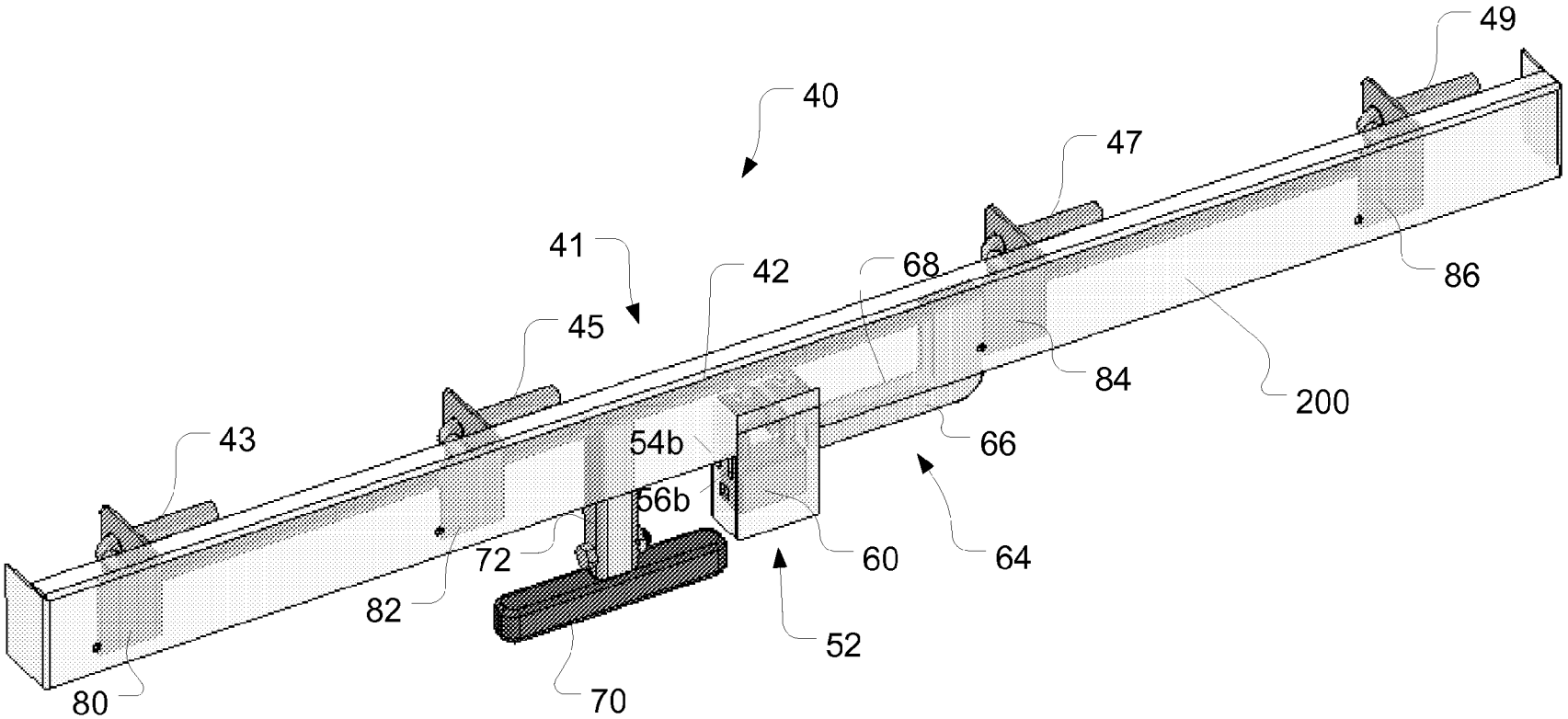
FIG. 17 is a perspective view of an alternate embodiment of the lock system of the present invention.

Turning to FIG. 17, an alternate embodiment of the lock system 40 is shown. This embodiment includes all of the same elements as the previous embodiment of the lock system 40 of the horizontal toolbox 10, and thus the same reference numbers refer to the same elements described above. In this embodiment, the lock system 40 further includes a plate 200 to secure the lock system 40 to the box 10. The brackets 80, 82, 84 and 86 secure the lock system 40 to the plate 200. The plate 200 is, in turn, coupled to the front wall 18 of the box 10, such as by welding. Alternatively, plate 200 may be secured to the front wall 18 by any known fastening means. The plate 200 facilitates the assembly of the lock system 40 to the body 12. It should be appreciated that this alternate embodiment of the lock system may also be used with the vertical lock box 110, in which case the plate 200 would secure the lock system 140 to the door 114 of the box 110.

While the latch rod 42 and the padlock 60 are both disposed within the body 12 of the tool box 10, it will be appreciated by those of skill in the art that the padlock 60 and latch rod 42 may be alternately disposed within the box. For example, by using the lock housing configured as in FIG. 3*c*, the latch rod 42 may be disposed within the body 12, while the padlock 60 may be coupled to the lid 14, as long as the padlock 60 acts to limit the travel of the latch rod 42 when the lid 14 of the horizontal tool box 10 is in the closed position. Furthermore, the entire lock system 40 may be coupled to the lid 14 while the flanges 44, 46, 48, and 50 may be provided on the body 12. Similarly, in the embodiment of FIGS. 10-14, the flanges 144, 146, 148, and 150 may be provided on a centerpost of the box 110 with the latch rod 142 provided on one of the two doors 114, 115.

It will be appreciated now that what has been provided is a significantly improved padlock-protecting lock system for a horizontal or vertical tool box which is simple, robust, and reliable. While the invention has been described in connection with certain embodiments, it will be understood that it is not intended to limit the invention to those particular embodiments. On the contrary, it is intended to cover all alternatives modifications, and equivalents included within the spirit and scope of the invention as defined by the appended claims.

We claim:

1. A lock system for use in a storage container having a first body component and a second body component, the lock system comprising:

a latch rod located on the first or the second body component of the storage container;

a lock engager coupled to the latch rod;

a lock housing positioned on the storage container adapted for having a lock positioned therein, and having at least one slot for accommodating the lock engager, wherein the lock has a key insertion surface facing in a downward direction;

an opening for providing access to the key insertion surface of the lock when positioned within the lock housing, the opening being located in an external recessed portion of the storage container; and a handle extending from the latch rod;

wherein when the lock is unlocked and the handle is moved in a first direction, the latch rod slides from a latched position to an unlatched position where the lock engager passes through the at least one slot of the lock housing and past the lock, and when the handle is moved in a second direction and the lock is locked, the latch rod slides from an unlatched position to a latched position where the lock blocks movement of the lock engager.

2. The lock system of claim 1 further comprising at least one protruding segment extending from the latch rod, the at least one protruding segment being offset from the latch rod.

3. The lock system of claim 2 further comprising at least one flange secured to the second body component for engaging the at least one protruding segment of the latch rod when the latch rod is in the latched position.

4. The lock system of claim 1 wherein the first direction is opposite the second direction.

5. The lock system of claim 1 wherein the lock housing is aligned with the opening.

6. The lock system of claim 1 wherein the external recessed portion includes a top portion and a bottom wall, the opening being located in the top portion.

7. The lock system of claim 1 wherein the handle is accessible from an outside of the storage container.

8. The lock system of claim 1 wherein the first body component comprises a body and the second body component comprises a lid mounted on the body.

9. The lock system of claim 8 wherein the lid includes at least one flange that engages the latch rod when the latch rod is in the latched position.

10. The lock system of claim 9 wherein the latch rod has a lateral axis and the at least one flange is disposed in a plane substantially perpendicular to the lateral axis.

11. The lock system of claim 2 wherein the latch rod is disposed to move along a first lateral axis and the at least one protruding segment is disposed to move along a second lateral axis, the first and second lateral axes being disposed substantially parallel.

12. The lock system of claim 1 wherein the first body component comprises a first door and the second body component comprises a second door.

13. The lock system of claim 12 wherein the second door includes at least one flange that engages the latch rod when the latch rod is in the latched position.

14. The lock system of claim 13 wherein the latch rod has a longitudinal axis and the at least one flange is disposed in a plane substantially perpendicular to the longitudinal axis.

15. The lock system of claim 1 wherein the first body component comprises a body and the second body component comprises at least one door.

16. The lock system of claim 15 wherein the body includes at least one flange that engages the latch rod when the latch rod is in the latched position.

17. The lock system of claim 1 wherein the lock is a padlock having a shackle and a lock body, the shackle being substantially inaccessible from an outside of the storage container, the key insertion surface being on the lock body.

18. The lock system of claim 1 wherein the first body component includes an enclosed space, and at least a portion of the latch rod is disposed substantially adjacent a wall of the first body component such that any intrusion of the latch rod into the enclosed space is substantially minimized.

19. The lock system of claim 1 further comprising at least one bracket for securing the latch rod to the storage container.

20. The lock system of claim 1 further comprising a plate for securing the lock system to the storage container.

21. The lock system of claim 1 wherein the handle is positioned within and accessible within the recessed portion.

22. The lock system of claim 1 wherein the opening is positioned within a first recessed portion and the handle is positioned within a second recessed portion.

23. The lock system of claim 1 wherein the lock engager is a rod.

24. The lock system of claim 1 wherein the lock engager comprises at least one leg for aligning with the at least one slot of the lock housing when the latch rod is in the unlatched position.

25. The lock system of claim 1 wherein the handle is a knob.

26. A lock system for use in a horizontal storage container having a first body component and a second body component, the lock system comprising:

a latch rod located on the first body component of the storage container;

a lock engager coupled to the latch rod;

a lock housing positioned within the storage container adapted for having a lock oriented vertically therein, and having at least one slot for accommodating the lock engager;

an external recessed portion located on the storage container, the external recessed portion having a top portion and a bottom wall;

an opening positioned in the top portion of the external recessed portion for providing access to a portion of the lock when oriented vertically within the lock housing;

at least one flange positioned on the second body component; and a handle extending from the latch rod and being accessible from outside the storage container;

wherein when the lock is unlocked and the handle is moved laterally in a first direction, the latch rod slides to an unlatched position where the lock engager can move past the lock, and when the handle is moved laterally in a second direction and the lock is locked, the latch rod engages the at least one flange and slides to a latched position where the lock blocks movement of the lock engager.

27. The lock system of claim 26 further comprising at least one protruding segment extending from the latch rod, the at least one protruding segment being offset from the latch rod.

28. The lock system of claim 27 wherein the latch rod is disposed to move along a first lateral axis and the at least one protruding segment is disposed to move along a second lateral axis, the first and second lateral axes being disposed substantially parallel.

29. The lock system of claim 26 wherein the lock is a padlock having a shackle and a body, the shackle being substantially inaccessible from an outside of the storage container.

30. The lock system of claim 29 wherein the lock body has a key insertion surface that is exposed for external access through the opening.

31. The lock system of claim 26 wherein the handle is positioned within and accessible within the recessed portion.

32. The lock system of claim 26 wherein the lock engager comprises at least one leg for aligning with the at least one slot of the lock housing when the latch rod is in the unlatched position.

33. The lock system of claim 26 wherein the first body component is a body and the second body component is a lid.

34. The lock system of claim 26 wherein the lock includes a key insertion surface that is flush with the top portion of the external recessed portion.

35. A lock system for use in a vertical storage container having a first body component and a second body component, the lock system comprising:

a latch rod located on the first body component of the storage container;

a lock engager coupled to the latch rod;

a lock housing positioned within the storage container adapted for having a lock positioned horizontally therein, and having at least one slot for accommodating the lock engager;

an external recessed portion located on the storage container, the external recessed portion having a top wall, a bottom wall, and two side walls;

an opening positioned in a side wall of the external recessed portion for providing access to a portion of the lock when oriented horizontally within the lock housing;

at least one flange positioned on the second body component; and a handle extending from the latch rod and being accessible from outside the storage container;

wherein when the lock is unlocked and the handle is moved longitudinally in a first direction, the latch rod slides to an unlatched position where the lock engager can move past the lock, and when the handle is moved longitudinally in a second direction and the lock is locked, the latch rod engages the at least one flange and slides to a latched position where the lock blocks movement of the lock engager.

36. The lock system of claim 35 further comprising at least one protruding segment extending from the latch rod, the at least one protruding segment being offset from the latch rod.

37. The lock system of claim 36 wherein the latch rod is disposed to move along a first longitudinal axis and the at least one protruding segment is disposed to move along a second longitudinal axis, the first and second longitudinal axes being disposed substantially parallel.

38. The lock system of claim 35 wherein the lock is a padlock having a shackle and a body, the shackle being substantially inaccessible from the outside of the storage container.

39. The lock system of claim 38 wherein the lock body has a key insertion surface that is exposed for external access through the opening.

40. The lock system of claim 35 wherein the first body component is a body and the second body component is a door.

41. The lock system of claim 35 wherein the first body component and the second body component are both doors.

42. The lock system of claim 35 wherein the lock engager comprises at least one leg for aligning with the at least one slot of the lock housing when the latch rod is in the unlatched position.

* * * * *